US005915400A

United States Patent [19]

Pohl et al.

[11] Patent Number: 5,915,400

[45] Date of Patent: Jun. 29, 1999

[54] TENT WITH SELF-ERECTING FRAMES

[75] Inventors: Harold J. Pohl, Washington; Lloyd W. Moeckli, New Haven, both of Mo.

[73] Assignee: American Recreation Products, Inc., St. Louis, Mo.

[21] Appl. No.: 08/834,486

[22] Filed: Apr. 14, 1997

[51] Int. Cl.[6] ..... E04H 15/40

[52] U.S. Cl. ..... 135/125; 135/120.3; 135/120.4; 135/117; 135/93; 403/176; 403/218

[58] Field of Search ..... 135/125, 126, 135/128, 120.3, 120.4, 114, 115, 116, 117, 151, 96, 93; 248/168, 180.1, 173; 403/144, 176, 218

[56] References Cited

U.S. PATENT DOCUMENTS

| | | | |
|---|---|---|---|
| 2,113,118 | 4/1938 | Pyatt | 135/123 |
| 2,516,869 | 8/1950 | Harris | 135/126 |
| 2,828,755 | 4/1958 | Stockman | 135/1 |
| 3,010,464 | 11/1961 | Moss | 135/5 |
| 3,174,493 | 3/1965 | Gruenberg . | |
| 3,716,211 | 2/1973 | Butz | 248/168 |
| 3,759,277 | 9/1973 | Glade | 135/4 R |
| 4,077,417 | 3/1978 | Beavers | 135/120.3 X |
| 4,332,266 | 6/1982 | Wageley | 135/5 R |
| 4,576,116 | 3/1986 | Binkert | 119/19 |
| 4,646,770 | 3/1987 | Lobato | 135/102 |
| 4,716,918 | 1/1988 | Hayashida et al. | 135/93 |
| 4,757,832 | 7/1988 | Russell | 135/106 |
| 4,941,499 | 7/1990 | Pelsue et al. | 135/125 |
| 4,966,178 | 10/1990 | Eichhorn | 135/125 X |
| 5,069,572 | 12/1991 | Niksic | 135/147 X |
| 5,199,375 | 4/1993 | Johson | 116/209 |
| 5,343,887 | 9/1994 | Danaher | 135/104 |
| 5,458,146 | 10/1995 | Gregg | 135/91 |
| 5,467,794 | 11/1995 | Zheng | 135/125 |

FOREIGN PATENT DOCUMENTS

| | | | |
|---|---|---|---|
| 2273723 | 6/1994 | United Kingdom | 135/143 |

OTHER PUBLICATIONS

*Slumberjack 1995 Outdoor Sleeping Products* product catalog, pp. 30.

*Primary Examiner*—Carl D. Friedman
*Assistant Examiner*—Winnie S. Yip
*Attorney, Agent, or Firm*—Senniger, Powers, Leavitt & Roedel

[57] ABSTRACT

A tent has an elongate shell of limp material and a pair of self-erecting frames movable between an erect configuration in which the frames are capable of supporting the shell to define an interior space of the shell and a collapsed configuration in which the shell is compacted and stored in a storage bag. Each of the self-erecting frames comprises a plurality of frame members having an upper end and a lower end. A connecting system connects the upper ends of the frame members and biases the lower ends of the frame members apart to move the frame to its erect configuration. The frame members are movable against the bias of the connecting system to move the frame from its erect configuration to its collapsed configuration. In another embodiment, a portion of the shell comprises a mesh window panel to permit air flow in and out of the interior space of the tent. A window flap is connected to the shell adjacent the window panel for covering the window panel. Means are provided within the interior space of the tent for selectively moving the window flap between a covering position in which the window flap covers the window panel and a non-covering position in which the window panel is exposed, without removing any portion of the shell to access the window flap.

17 Claims, 9 Drawing Sheets

55
37
71
205
107
53
201
79
117
205
201
25
217
59
213
217
115
209
79
203
109
201
51
103
205
203
71

TENT WITH SELF-ERECTING FRAMES

BACKGROUND OF THE INVENTION

This invention relates generally to tents, and more particularly to tents having self-erecting frames.

Tents of conventional construction typically include a tent shell supported by a frame comprising multiple frame members. These tents are time consuming to erect and strike. For example, one-person tents such as bivouac tents used by backpackers, hunters, fishermen, mountain hikers, kayakers and canoeists, and minimal gear hikers often require two or more tent poles that must be assembled together and attached to the tent by passing the poles through a fabric sleeve of the tent shell. These tent poles are generally carried by the user in a disassembled form, separate from any connection with the tent. As such, the user must assemble and disassemble the tent poles and shell each time the tent is to be erected, used and then collapsed for storage and transport. This process is cumbersome and time consuming and also increases the risk that a tent pole may become separated and lost from the tent.

Numerous efforts have been made to simplify the frames and reduce the number of component members making up the frame. The primary difficulty is that reducing the number of frame members often reduces the stability of the tent. For example the portable fabric structure disclosed in U.S. Pat. No. 5,343,887 includes a pair of annular hoops at opposing ends of the structure. However, the generally cylindrical structure defined by these hoops is unstable against roll and requires additional support members carried separately from the structure, thus requiring additional time and effort for connecting the support members to the structure.

SUMMARY OF THE INVENTION

Among the several objects and features of the present invention may be noted the provision of a tent which can be easily and quickly erected; the provision of such a tent which has self-erecting; the provision of such a tent in which all support components of the frames remain connected to each other and to the tent shell whether the tent is erect or compacted; the provision of such a tent which is light weight and easy to collapse and compact for storage and for carrying on hiking trips; the provision of such a tent in which the frame cannot become separated from the shell of the tent, the provision of such a tent which is of economical construction, and the provision of such a tent which is easily ventilated without opening the shell of the tent.

Briefly, a tent of this invention comprises an elongate shell made of limp material. A pair of self-erecting frames at opposing ends of the shell are movable between erect configurations capable of supporting the shell so that the shell defines an interior space of the tent, and collapsed configurations in which the shell can be compacted for storage and transport of the tent. Each of the self-erecting frames comprises a plurality of frame members each having an upper end and a lower end. A connecting system connects the upper ends of the frame members and biases the lower ends of the frame members apart to move the frame to its erect configuration. The frame members are movable against the bias of the connecting system to move the frame from its erect configuration to its collapsed configuration. The self-erecting frames are connected to the shell so that movement of the frames toward their erect configurations is adapted to expand the shell of the tent to facilitate erection of the tent.

In another embodiment, a self-erecting frame of the present invention for supporting a tent in an erect configuration of the tent comprises a plurality of frame members, each frame member having an upper end and an lower end. A rigid retaining member has openings therein for receiving the upper ends of the frame members. The frame members are retained by said retaining member and capable of pivotal movement with respect to the retaining member. Torsion springs associated with the frame members bias the frame members apart to define an erect configuration of the frame. The frame members are pivotably movable against the bias of the torsion springs to define a collapsed configuration of the frame.

In yet another embodiment, a tent of the present invention comprises an elongate shell constructed of a limp material and a frame capable of supporting the shell in an erect configuration so that the shell defines an interior space of the tent. A portion of the shell comprises a mesh window panel to permit air flow in and out of the interior space of the tent. The tent further comprises a window flap connected to the shell adjacent the window panel for covering the window panel. Moving means is provided within the interior space of the tent for selectively moving the window flap between a covering position in which the window flap covers the window panel and a non-covering position in which the window panel is exposed. The moving means allows the window flap to be moved between its covering and non-covering position by a person inside the interior space of the tent without removing any portion of the shell to access the window flap.

Other objects and features will become in part apparent and in part pointed out hereinafter.

BRIEF DESCRIPTION OF THE DRAWINGS

Corresponding parts are designated by corresponding numerals throughout the several views of the drawings.

DESCRIPTION OF THE PREFERRED EMBODIMENT

Figures 1, 2, 3:
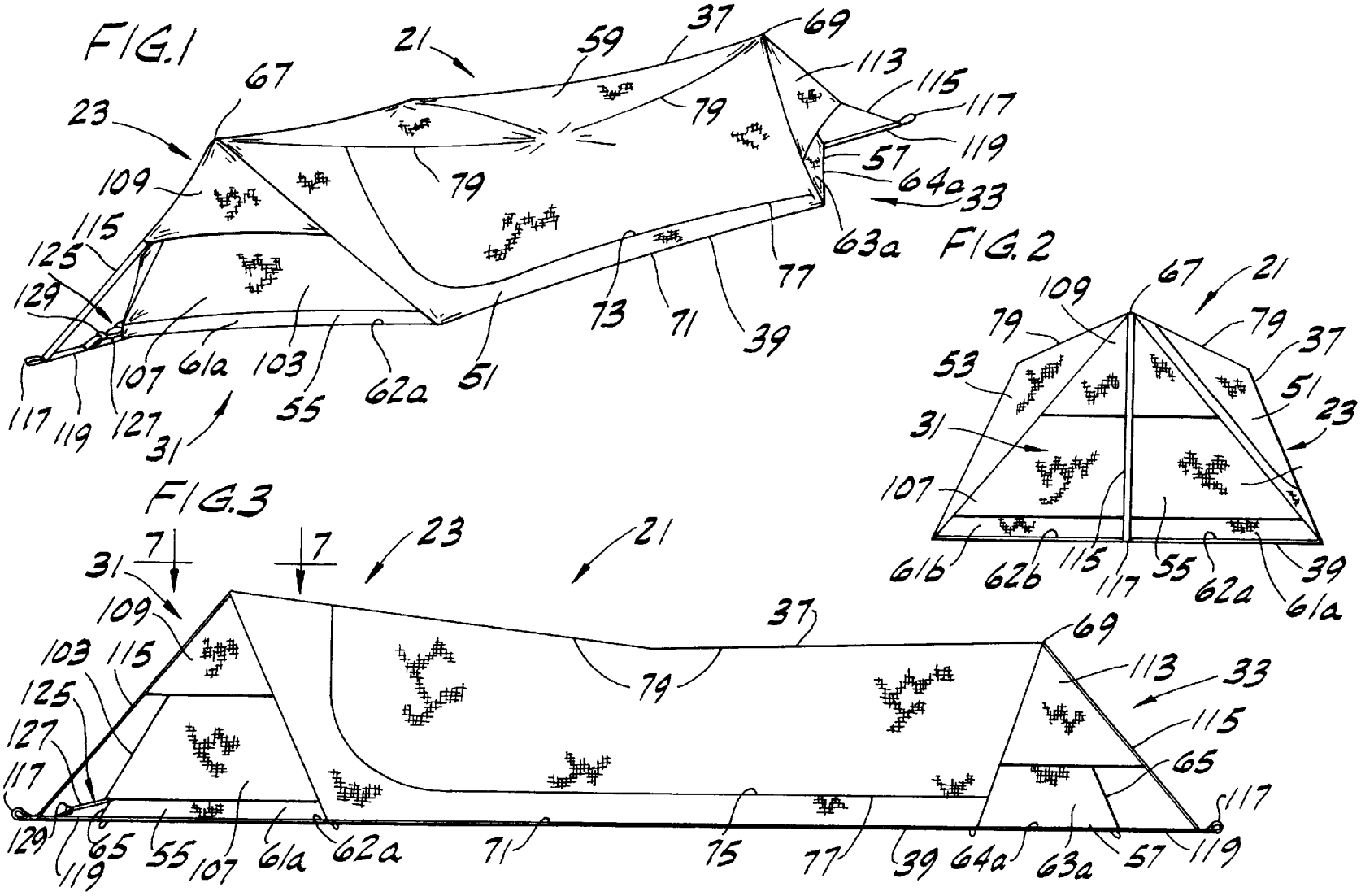
FIG. 1 is a perspective view of a tent of the present invention shown erect.
FIG. 2 is a front elevation thereof.
FIG. 3 is a side elevation thereof.

Referring now to the drawings, and in particular to FIG. 1, a tent constructed according to the principles of the present invention is designated in its entirety by the reference numeral 21. The tent 21 comprises an elongate shell, generally designated 23, and a pair of self-erecting frames, generally designated 25 (FIG. 5) and 27 (shown collapsed in phantom in FIG. 13), respectively, for supporting the shell to define an interior space of the tent capable of accommodating one or more persons. The tent shell 23 is constructed of a flexible or limp material, preferably nylon with a urethane backing, so that the shell may be quickly and easily expanded and supported by the frames 25, 27 when the frames are erected, and may also be folded, rolled or otherwise gathered into a compact configuration for storing or transporting the tent in a suitable storage bag 29 (FIG. 13) when not in use. The tent 21 shown in FIG. 1 is sized and configured for use as a bivouac tent accommodating a single person lying down in the tent and has a head end, generally indicated at 31 and a foot end, generally indicated at 33. However, it will be understood that the present invention is also applicable to tents which can accommodate more than one person. It is also understood that the storage bag 29 is not necessary to this invention and that one or more straps (not shown) may be secured around the compacted tent to provide a lighter weight method of storing and transporting the tent.

Figure 14:
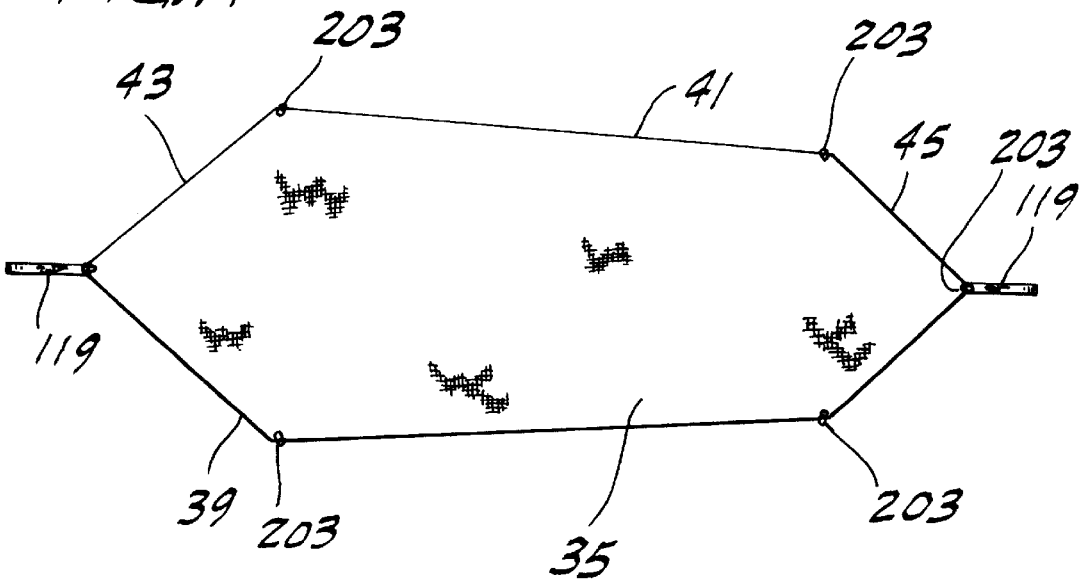
FIG. 14 is a bottom plan view of FIG. 1.

The tent shell 23 comprises a floor 35 (FIG. 14) and a canopy 37 secured to the floor along a peripheral edge margin 39 of the floor such as by sewing the canopy to the floor or by other suitable fastening methods. The floor 35 of the shell 23 is preferably of single-panel construction, having generally a rectangular mid-section 41 and opposing, triangular end sections 43, 45 corresponding, respectively, to the head and foot ends 31, 33 of the tent 21. As seen in the drawings, the head end section 43 of the floor 35 is sized larger than the foot end section 45 to allow more room for the user's upper body and head and for storing various gear or other accessories. The edge margins 39 of the mid-section 41 taper outward towards the head end 31 of the tent 21 to further accommodate the upper body of the user. The floor 35 of the shell 23 is sized according to the number of persons for which the interior space of the tent 21 is designed. For example, the floor 35 of the tent 21 shown in FIG. 1 is approximately 101 inches long (e.g. end-to-end) and its mid-section 41 is approximately 38 inches wide adjacent the head end section 43 of the floor and 30 inches wide adjacent the foot end section 45 of the floor.

The canopy 37 of the shell 23 is defined by side walls 51, 53, opposing end walls 55, 57 and a roof 59. The end walls 51, 53, corresponding, respectively, to the head and foot ends 31, 33 of the tent 21, comprise adjacent, generally triangular panels 61*a*, 61*b*, 63*a*, 63*b* having bottom edges 62*a*, 62*b*, 64*a*, 64*b* secured to the respective edge margin 39 of the floor 35 along its triangular end sections 43, 45. The two end panels 61*a*, 61*b*, 63*a*, 63*b* of each end wall 51, 53 slope generally inward and upward and are connected along inner side margins of the panels by sewing along a seam line 65 (FIG. 3) extending from the bottom edges 62*a*, 62*b*, 64*a*, 64*b* of the panels to the tops of the panels. The connected tops of the panels 61*a*, 61*b*, 63*a*, 63*b* define respective apexes 67, 69 of the head and foot ends 31, 33 of the tent 21. In the preferred embodiment, the apex 67 of the head end 31 of the tent 21 is disposed higher than the apex 69 of the foot end 33 of the tent. As an example, the apex 67 of the head end 31 of the tent 21 shown in FIG. 1 is approximately 22 inches high, while the apex 69 of the foot end 33 of the tent is approximately 18 inches high. The side walls 51, 53 extend longitudinally between the end walls 55, 57 and have bottom edges 71 secured to the edge margin 39 of the mid-section 41 of the floor 35. One of the side walls 51 has a door opening (not shown) for entering and exiting the interior space of the tent, and a door 75 including a solid panel for selectively opening and closing the door opening. The door 75 extends longitudinally substantially the entire length of the side wall 51 and is releasably connected to the side wall by a zipper fastener 77.

Figure 4:
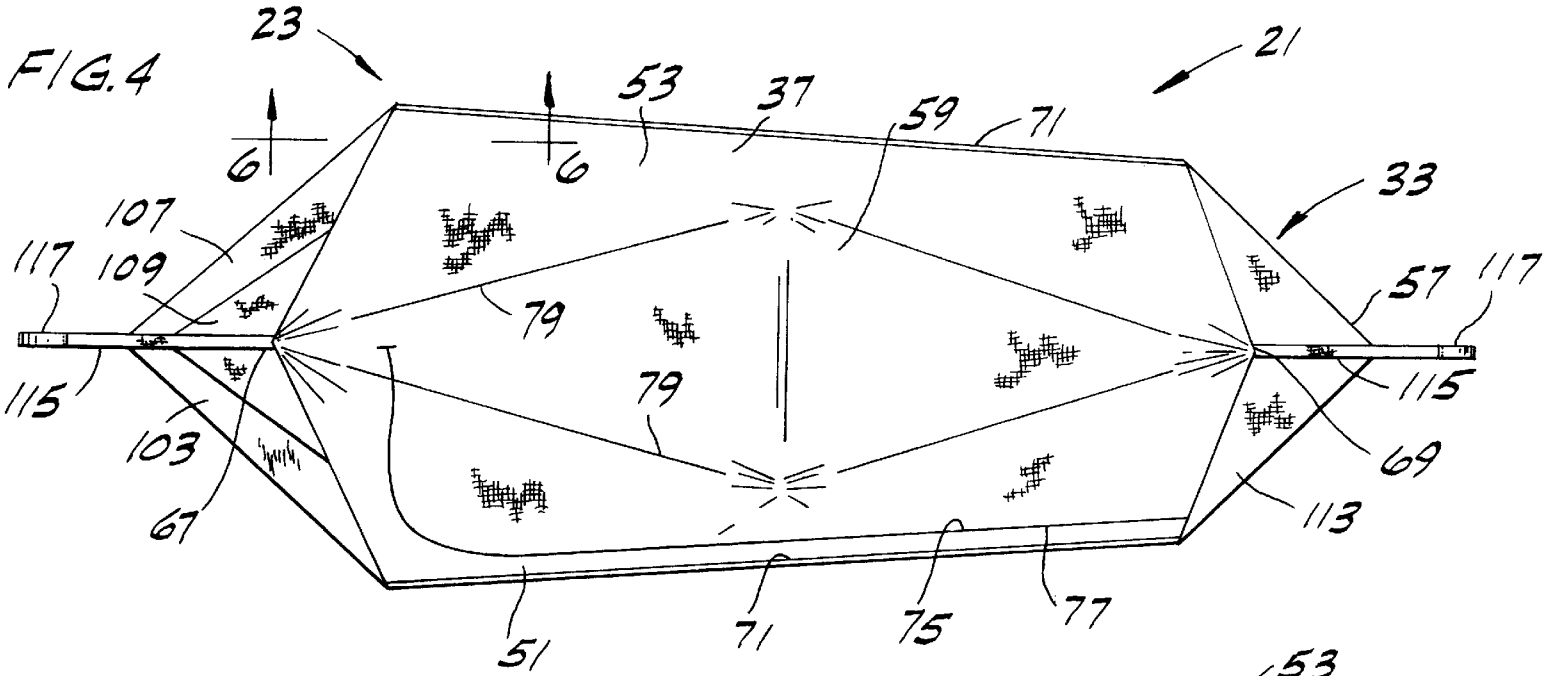
FIG. 4 is a top plan view thereof with a portion of a shell of the tent removed to reveal interior structure.

As seen in FIG. 4, the roof 59 is generally diamond shaped and extends between the apexes 67, 69 of the tent 21 so that the edges 79 of the roof define the eaves of the roof. The side walls 51, 53 slope down and away from the roof 59 of the shell 23 for draining water, such as rain or dew, off of the roof and away from the tent 21. The roof 59 has a sleeve (not shown) attached to its underside extending transversely between the side walls 51, 53 of the shell 23 intermediate (approximately midway between) the apexes 67, 69 of the tent 21. This sleeve is open at one end and is adapted for receiving a cross-support member (not shown) comprising a rod, preferably constructed of fiberglass, for widening the interior space of the tent 21 above the mid-section 41 of the floor 35 when the tent is erect. A closure flap (not shown) attached to the open end of the sleeve is closable over its open end, such as by using VELCRO or other suitable fasteners, for releasably securing the cross-support member within the sleeve. In the preferred embodiment, the side walls 51, 53 and roof 59 are constructed of two panels connected along a seam line (not shown) extending between the apexes 67, 69 of the tent 21. However, it is to be understood that the side walls 51, 53 and roof 59 may be constructed of any number of panels, or may be integrally formed, without departing from the scope of this invention.

Figure 6:
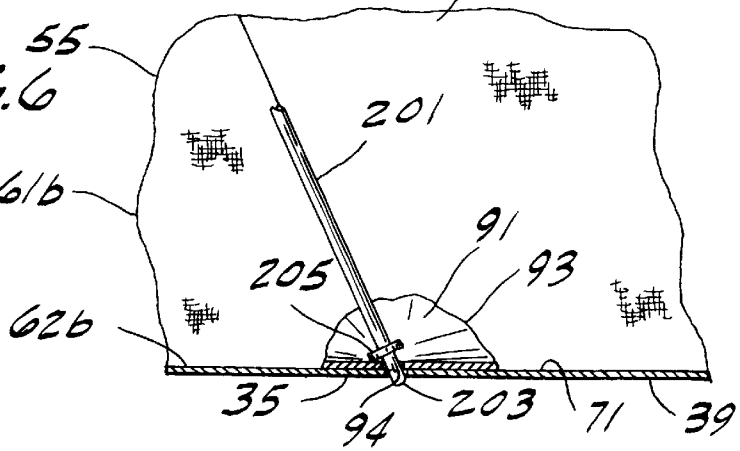
FIG. 6 is an enlarged section taken in the plane of line 6—6 in FIG. 4.

Interior pockets 91 (one of which is shown in FIG. 6) are formed at corners of the end sections 43, 45 of the floor 35 by the connection of the floor, the side walls 51, 53 and the two end panels 61*a*, 61*b*, 63*a*, 63*b* of each of the end walls 55, 57. A similar pocket 95 (FIG. 7) is formed by the connection of the roof 59, the side walls 51, 53 and the two end panels 61*a*, 61*b*, 63*a*, 63*b* of the end walls 55, 57 at each apex 67, 69 of the tent 21. Each of these pockets 94, 95 is lined with a layer of reinforcing material 93, 97, such as woven polyester, and is adapted for receiving a portion of the frames 25, 27 to secure the frames within the shell 23.

Figure 7:
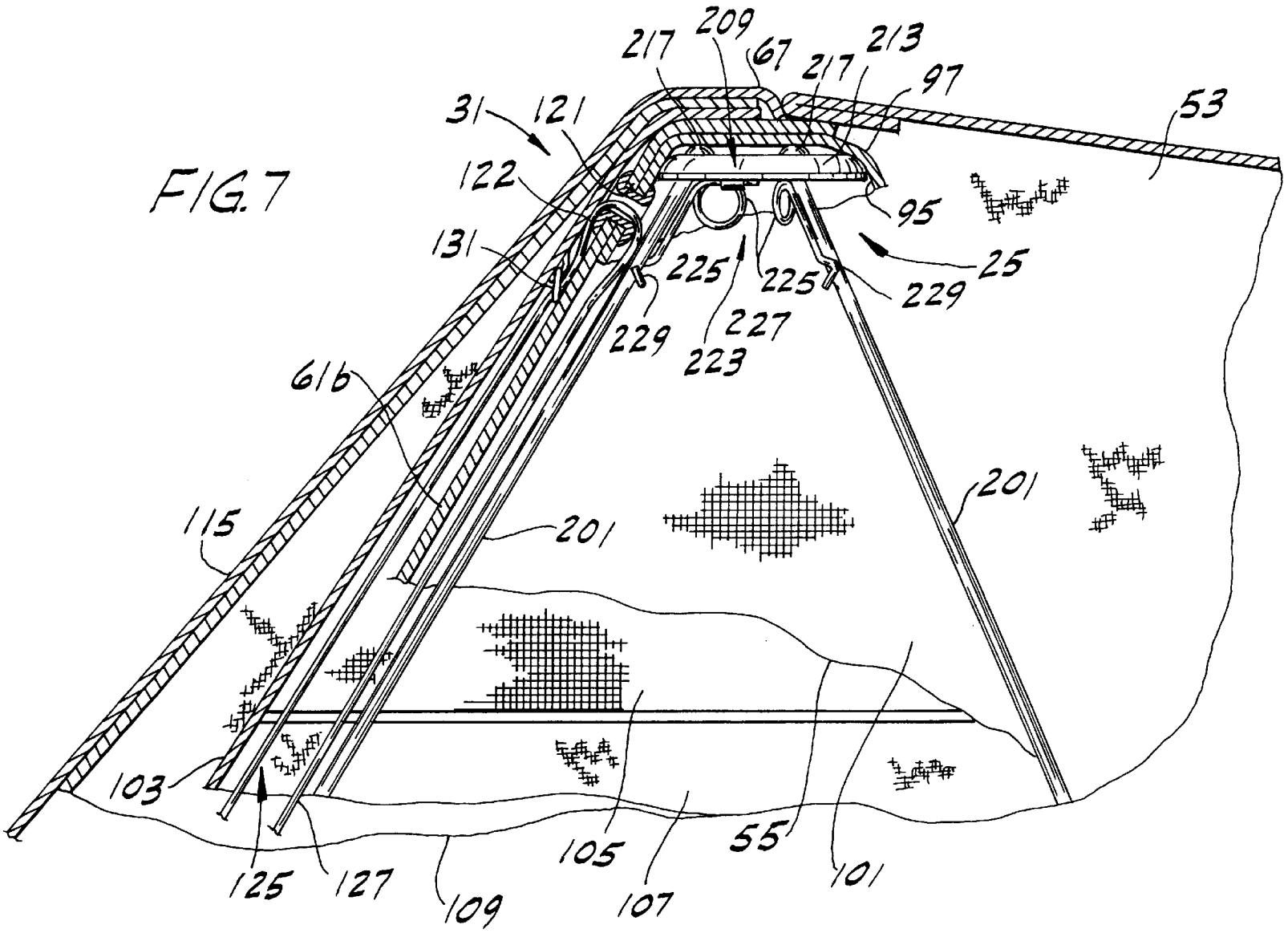
FIG. 7 is a partial section taken in the plane of line 7—7 of FIG. 3.

Referring to FIG. 7, a portion of the end wall 55 at the head end 31 of the tent 21 has a mesh window panel 101 constructed of polyester netting to allow ventilation of the air within the interior space of the tent. A window flap 103 is attached to the exterior of the end wall 55 generally above the window panel 101 and has a mesh upper portion 105 constructed of polyester netting and a lower portion 107 constructed of nylon with a urethane backing similar to the shell 23 of the tent 21. As will be explained later, the window flap 103 is movable between a covering position and a non-covering position. In its covering position, the window flap 103 hangs down over the window panel 101 and inhibits water contacting the lower portion 107 of the window flap against entering the interior space of the tent. A stationary flap 109 is also attached to the end wall 55 generally above the window flap 103 and overlays the mesh upper portion 105 of the window flap to inhibit water contacting the stationary flap from entering the interior space of the tent through the mesh upper portion of the window flap and the mesh window panel 101. The end wall 57 at the foot end 33 of the tent 21 has a mesh window panel (not shown) similar to the window panel 101 at the head end 33 of the tent, and a stationary flap 113 attached to the end wall generally above the window panel for overlaying the window panel. It is also contemplated that a window flap (not shown) may be attached to the end wall 57 at the foot end 33 of the tent 21 without departing from the scope of this invention.

Guys 115, preferably straps constructed of nylon webbing, are attached to the stationary flaps 109, 113 and extend outwardly away from the end walls 55, 57 of the tent. The guys 115 have loops 117 formed at their outer (lower) ends for receiving tent stakes (not shown) or other known devices for anchoring the guys to the ground to maintain the shell 23 erect and to stabilize the shell against movement or collapse caused by wind or other forces such as a person bumping into the tent. As seen in FIG. 3, each guy 115 extends between the ground and a respective apex 67, 69 of the tent and is attached to the respective stationary flap 109, 113 along substantially the entire length of the flap between the apex and the bottom edge of the flap to distribute the tension in the guy over a greater portion of the flap. A second set of straps 119 (FIG. 3) constructed of nylon webbing are attached to the floor 35 of the shell and extend longitudinally outward of the floor. The straps 119 are attached to the guys 115 adjacent the loops 117 so that the straps are pulled taut simultaneously with the guys.

Figure 11:
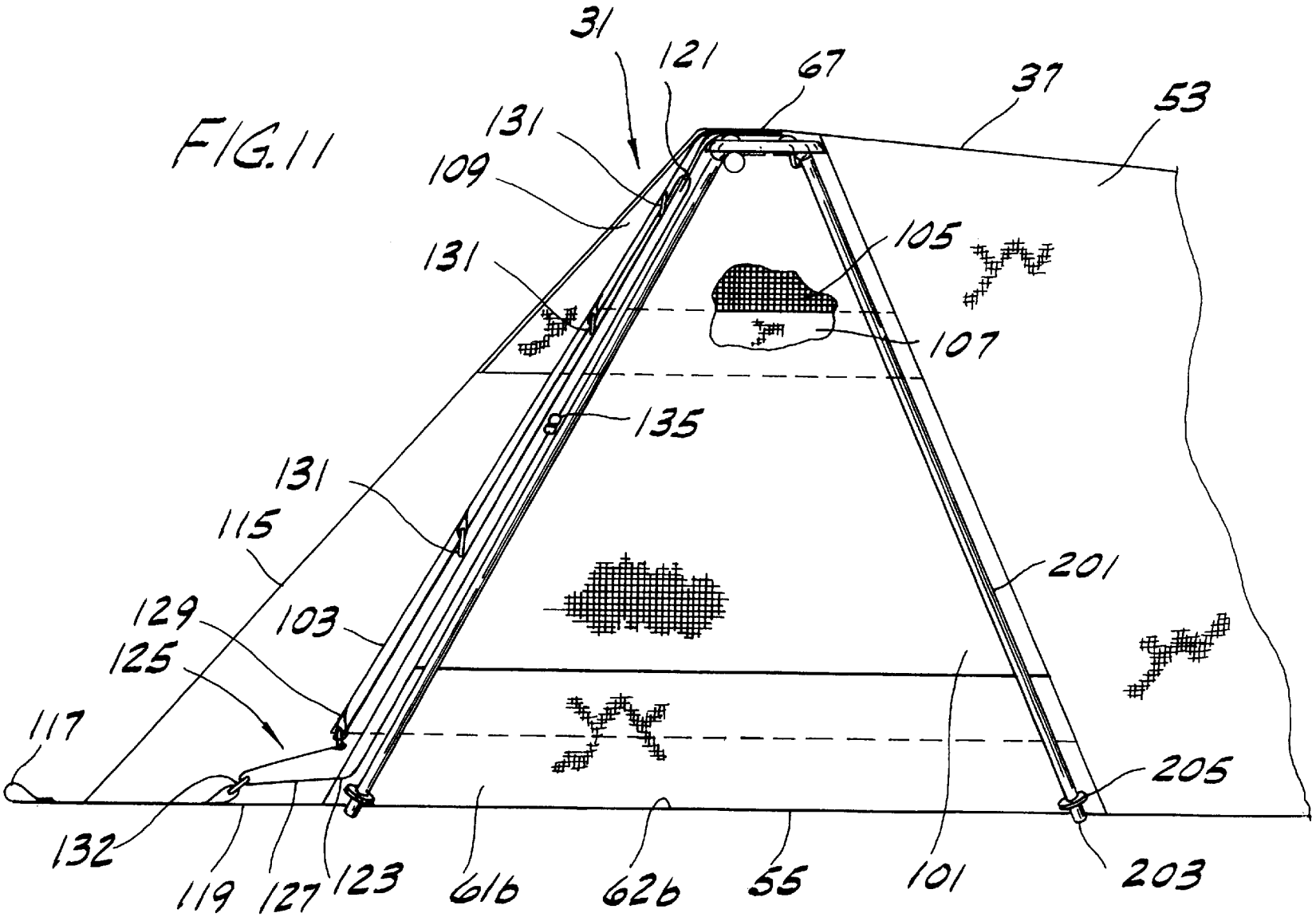
FIG. 11 is a schematic of FIG. 7 showing a window flap of the tent in a covering position.

The end wall 55 at the head end 31 of the tent 21 has an upper opening 121 (FIG. 7) defined by a grommet 122 located generally above the mesh window panel 101 and a lower opening 123 (FIG. 11) defined by a second grommet (not shown) located generally below the window panel along the seam line 65 connecting the end panels 61*a*, 61*b* of the end wall 55. With reference to FIG. 11, a loop, generally indicated at 125, is defined by looping a cord 127, preferably constructed of nylon rope, through the upper and lower openings 121, 123 and tying opposing ends of the rope to a coupling comprising a metal ring 129 attached to the bottom edge of the window flap 103 so that pulling on the cord effects movement of the window flap between its covering position and its non-covering position in which the flap is raised, partially or fully, above the window panel 101. A portion of the cord 127 thus extends within the interior space of the tent 21 between the upper and lower openings 121, 123 while the remaining portion of the cord extends generally along the exterior of the window panel 101 between the openings. The portion of the cord 127 extending along the exterior of the window panel 101 passes through additional metal rings 131 attached to the underside of the window flap 103 to maintain the cord in close relationship with the flap and another ring 132 (the ring 132 and strap 117 defining "coupling means" for coupling the cord to the guys 115) attached to the strap 117 so that the cord is spaced apart from the end wall 55 of the tent 21 to support the flap outward from the end wall. A suitable spring-biased clamp 135 is releasably retained on the portion of the cord 127 extending within the interior space of the tent 21 and is sized larger than the upper and lower openings 121, 123 so that the clamp cannot be pulled through the openings. The clamp 135 is biased to a clamping position in which the clamp is secured to the cord 127, and is adjustable against the bias to a non-clamping position in which the clamp is capable of sliding movement relative to the cord for repositioning the clamp to secure the window flap 103 in its non-covering position.

As previously discussed, the self-erecting frames 25, 27 of the present invention are located internally of the shell 23 at the head and foot ends 31, 33 of the tent. However, while the frames 25, 27 are shown and described herein as being internal of the shell 23, it is understood that the frames may be external of the shell without departing from the scope of this invention. Construction of these frames 25, 27 is now described herein with reference to the frame 25 at the head end 31 of the tent 21, the frame 27 at the foot end 33 of the tent being of essentially the same construction.

Figure 5:
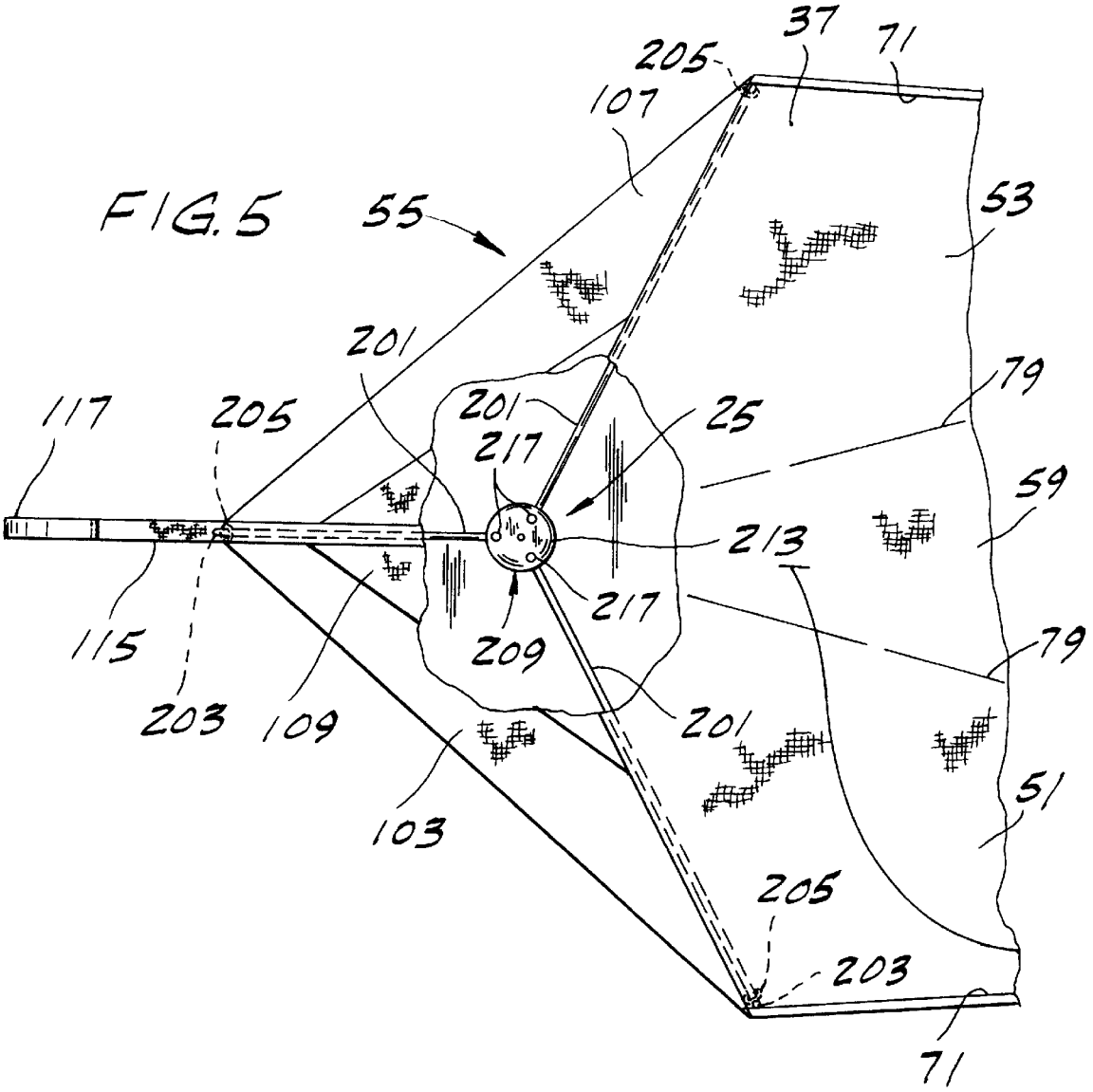
FIG. 5 is an enlarged, top plan view of a head end of the tent of FIG. 1 with a portion of the shell removed to reveal a frame within the shell.

Referring to FIG. 5, the frame 25 comprises three frame members 201, preferably constructed of fiberglass and arranged in a tripod configuration. The frame 25 is positioned in the shell 23 of the tent 21 so that one frame member 201 extends from adjacent the apex 67 down along the seam line 65 connecting the end panels 61*a*, 61*b* of the end wall 55 of the shell, and the other two frame members extend from adjacent the apex down along opposing outer side margins of the triangular end panels (i.e. on opposite sides of the shell) so that the interior space of the tent is unobstructed by the frame members. It is to be understood that the frame 25 may comprise more than three frame members 201 without departing from the scope of this invention. For example, the end section 43 of the floor 35 may be generally rectangular (not shown) and the frame may comprise four frame members, with two of the frame members disposed side-by-side at one side of the shell and two disposed side-by-side at the opposite side of the shell, without obstructing the interior space of the tent. It is also understood that the frame members 201 may be constructed of a more rigid material, such as aluminum or steel, without departing from the scope of this invention.

With particular reference to FIG. 6, lower ends 203 of the frame members 201 extend through openings 94 in the reinforced pockets 91 at the corners of the end section 43 of the floor 35 for engaging the ground. Annular flanges 205 adjacent the lower ends 203 of the frame members 201 prevent the shell 23 from sliding upward along the frame members. It is, however, contemplated that the lower ends 203 of the frame members 201 may seat solely within the reinforced pockets 91 without departing from the scope of the present invention. The frame members 201 also have enlarged, generally spherical upper ends 207. These upper ends 207 are preferably pre-formed and attached to the frame members 201 by any suitable method, such as by gluing the upper ends onto the frame members.

Figure 8:
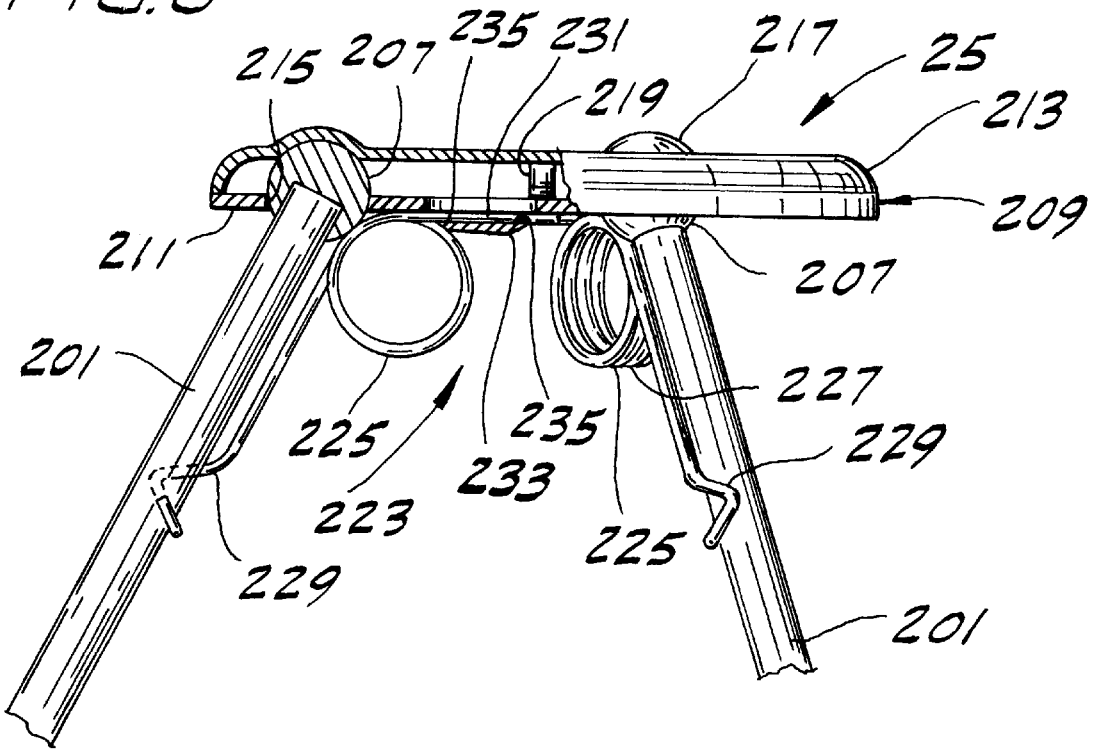
FIG. 8 is a fragmented side elevation of the frame with a portion removed to reveal internal structure.
Figure 9:
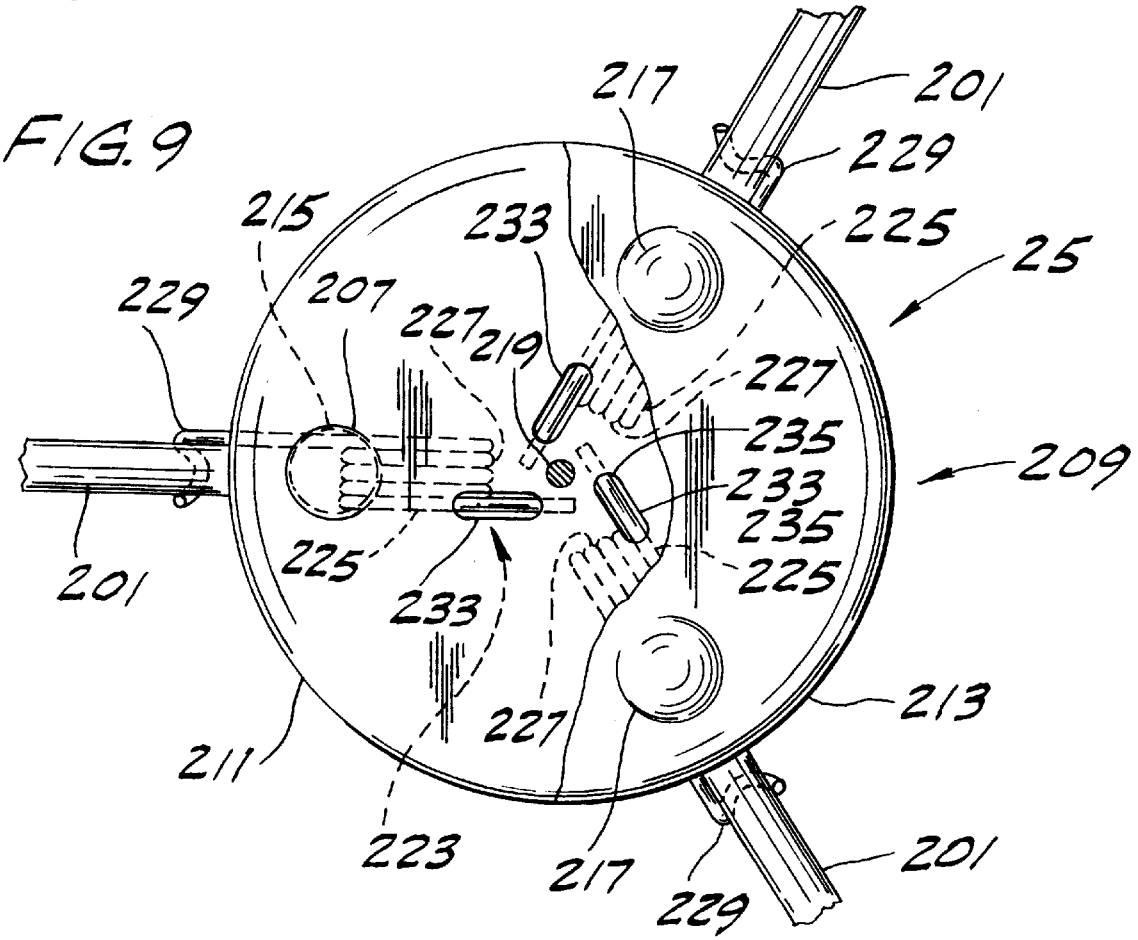
FIG. 9 is a fragmented top plan view of the frame with a portion of a cap removed to reveal internal structure.
Figure 10:
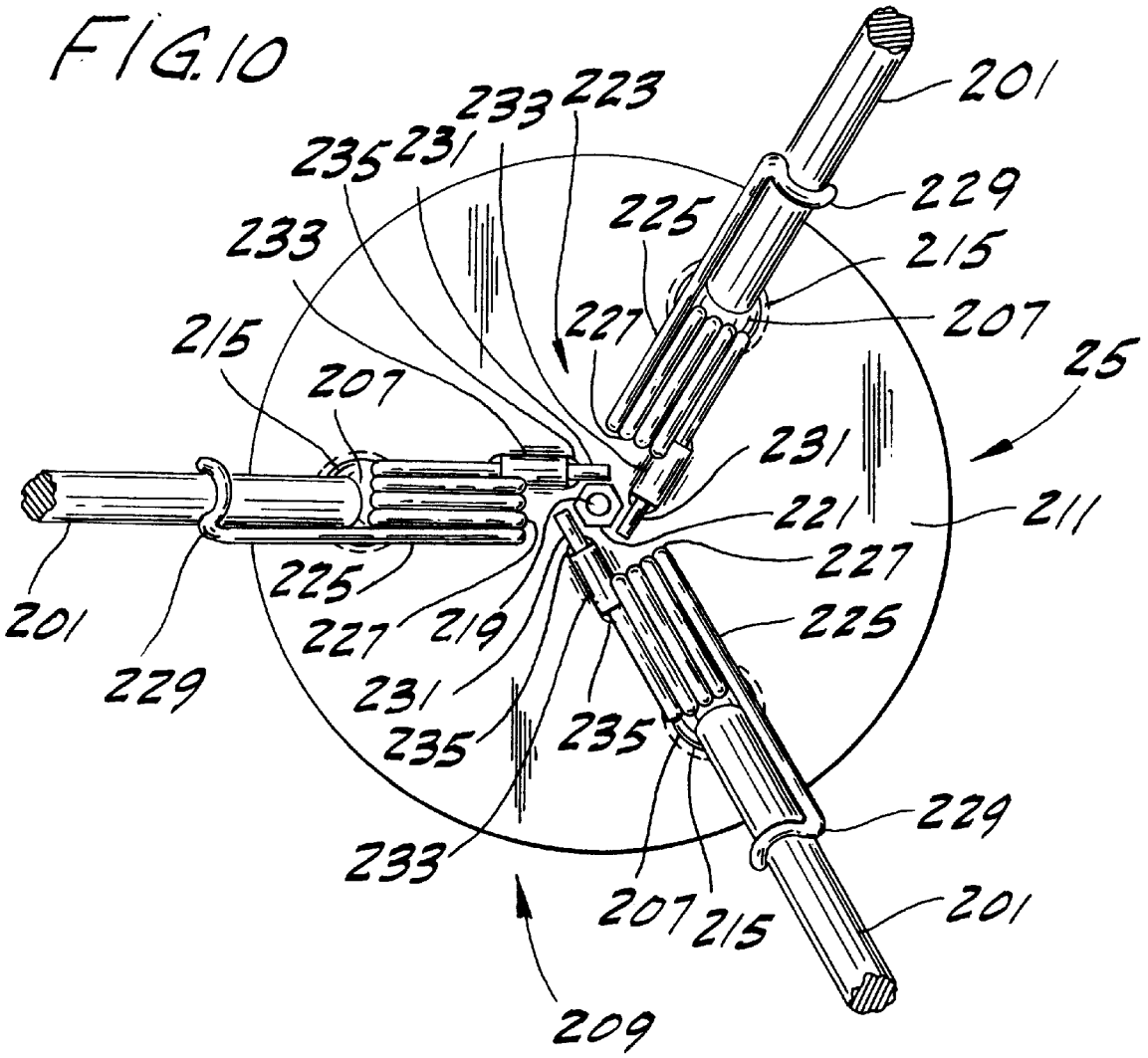
FIG. 10 is a fragmented bottom plan view of FIG. 9.

As shown in FIGS. 8–10, the upper ends 207 of the frame members 201 are connected together by a retaining member, indicated generally at 209, comprising a rigid plate 211 and a cap 213 mounted on the plate. The rigid plate 211 is generally circular and is constructed of aluminum or other suitable material. A plurality of openings, each designated 215, are provided in the plate 211 for receiving the upper ends 207 of the frame members 201. These openings 215, which are preferably spaced at equal intervals around the plate 211, are sized smaller than the spherical upper ends 207 of the frame members 201 and are adapted for seating the upper ends so that the remainder of the frame member extends down below the plate. The cap 213, also constructed of aluminum, mounts on the rigid plate 211 over the upper ends 207 of the frame members 201 and has dimples 217 that seat over the spherical upper ends to retain the upper ends of the frame members between the openings 215 in the plate and the dimples of the cap. The spherical upper ends 207 are thus capable of pivotable movement in the openings 215 (i.e. similar to a ball-and-socket joint), to permit angular movement of the frame members 201 between an-erect configuration of the frame 25 in which the frame members are spaced apart to form a tripod (as in FIG. 5) and a collapsed configuration of the frame (as shown in phantom in FIG. 13) in which the frame members are brought together in closely spaced relationship for compacting the tent 21. The cap 213 is secured to the rigid plate 211 by a conventional bolt 219 extending down through the cap and the plate, and a nut 221 threaded onto the bolt beneath the plate. As shown in FIG. 7, the retaining member 209 seats within the reinforced pocket 95 at the apex 67 of the head end 31 of the tent 21.

Still referring to FIGS. 8–10, a biasing system, generally indicated at 223, comprises three torsion springs 225 further connecting the frame members 201 together and biasing the frame members apart to the erect configuration of the frame 25. Each of the torsion springs 225 has a coil 227 and opposing first and second free ends 229, 231 extending tangentially from the coil. The first (lower) free end 229 of each spring 225 is shaped to form a cradle for receiving the frame member 201 whereby the outward bias of the torsion spring causes the frame member to move outward with respect to the rigid plate 211 while allowing the lower free end of the spring to slide along the frame member as the frame 25 is moved between its erect and collapsed configurations.

The second (upper) free ends 231 of the torsion springs 225 are received in channels 233 formed within the plate 211. These channels 233 extend in generally a radial direction adjacent the openings 215 in which the upper ends 207 of the frame members 201 are seated. The upper free end 231 of each torsion spring 225 extends through open ends 235 of a respective channel 233 so that the outward bias of the torsion spring causes the portions of the upper free end of the spring outward of the open ends of the channel to bear upward against the rigid plate 211 for retaining the second free end of the torsion spring within the channel. The outward bias of the torsion springs 225 is sufficient to urge the lower ends 203 of the frame members apart to move the frame from its collapsed configuration to its erect configuration without manipulation by the tent user. Connection of the floor 35 with the lower ends 203 of the frame members 201 via the annular flanges 205 allows the floor to limit further separation of the frame members once the floor is pulled taut by the frame members.

In the preferred embodiment, the retaining member 209 and biasing system 223 broadly define a connecting system for connecting the upper ends 207 of the frame members 201 and biasing the lower ends 203 of the frame members apart to move the frame 25 to its erect configuration. However, it is to be understood that the connecting system may be constructed in a different manner without departing from the scope of the invention, as long it holds the upper ends 207 of the frame members 201 together while biasing the lower ends 203 of the frame members apart. For example, the connecting system may comprise only the three torsion springs 225, with each spring having its first and second free ends 229, 231 connected to the respective upper ends 207 of two adjacent frame members 201 so that the upper ends are held in close relationship while the lower ends 203 of the frame members are biased apart.

To erect the tent 21 of the present invention, the compacted shell 23 and collapsed frame members 25, 27 are removed from the storage bag 29 and the shell is uncompacted and spread out the ground. As the shell 23 is uncompacted, the bias of the torsion springs 225 urges the lower ends 203 of the frame members 201 of the two frames 25, 27 to move apart. The upper ends 207 of the frame members 201 of each frame 25, 27 are retained by the rigid plate 211 and cap 213 of the retaining member 209 and pivot within the openings 215 of the rigid plate as the lower ends 203 move angularly outward with respect to the retaining member to form a tripod. The frames 25, 27 are maintained in their desired locations at the head and foot ends 31, 33 of the tent 21 by the reinforced pockets 95, 91 at the apexes 67, 69 and at the corners of the end sections 43, 45 of the floor 35. As the frame members 201 of each frame 25, 27 spread apart, the lower ends 203 of the frame members extending through the openings 94 in the reinforced pockets 91 expand the triangular end sections 43, 45 of the floor 35 and the end panels 61*a*, 61*b*, 63*a*, 63*b* of the canopy 37 to partially define the interior space of the tent 21. The annular flanges 205 adjacent the lower ends 203 of the frame members 201 prevent the floor 35 and end panels 61*a*, 61*b*, 63*a*, 63*b* from sliding up along the frame members to secure the floor and end panels in their expanded state and to limit further separation of the frame members once the floor is pulled taut.

The floor 35 of the shell 23 is then laid flat on the ground so that the frames 25, 27 are positioned upright and the lower ends 203 of the frame members 201 extending through the openings 94 in the reinforced pockets 91 engage the ground. The loop 117 attached to the guy 115 at one end of the tent (i.e., the head end 31) is anchored to the ground by a tent stake. The loop 117 attached to the guy 115 at the opposite end of the tent (i.e., the foot end 33) is pulled longitudinally outward, opposite the guy previously anchored to the ground, so that the shell 23 is placed in tension, causing the floor 35, roof 59 and side walls 51, 53 to expand between the frames 25, 27 to fully define the interior space of the tent 21. The loop 117 can be anchored to the ground by another tent stake. With the loops 117 anchored in this manner, the guys 115 are held taut and function to maintain the tent 21 erect and to stabilize the tent against movement or collapse. The stationary flaps 109, 113 attached to the end walls 55, 57 are pulled taut by the guys 115, each being held in spaced relation above its respective window panel 101. The portion of the cord 127 extending along the exterior of the window panel 101 at the head end 31 of the tent 21 is also pulled generally taut by the strap 119 extending horizontally between the floor 35 and the guy 115 to support the window flap 103 in its covering position.

Once erect, the interior space of the tent 21 extends substantially the entire distance between the end walls 55, 57 of the shell (i.e., including the space defined by the end panels 61*a*, 61*b*, 63*a*, 63*b* supported by the frames 25, 27) and is substantially unobstructed by the frames. The zipper fastener 77 is unfastened to open the door 75 for permitting the user to enter the tent through the door opening. The user then lies down in the tent 21 and fastens the zipper fastener 77 to close the door opening so that the user is fully enclosed within the tent.

Figure 12:
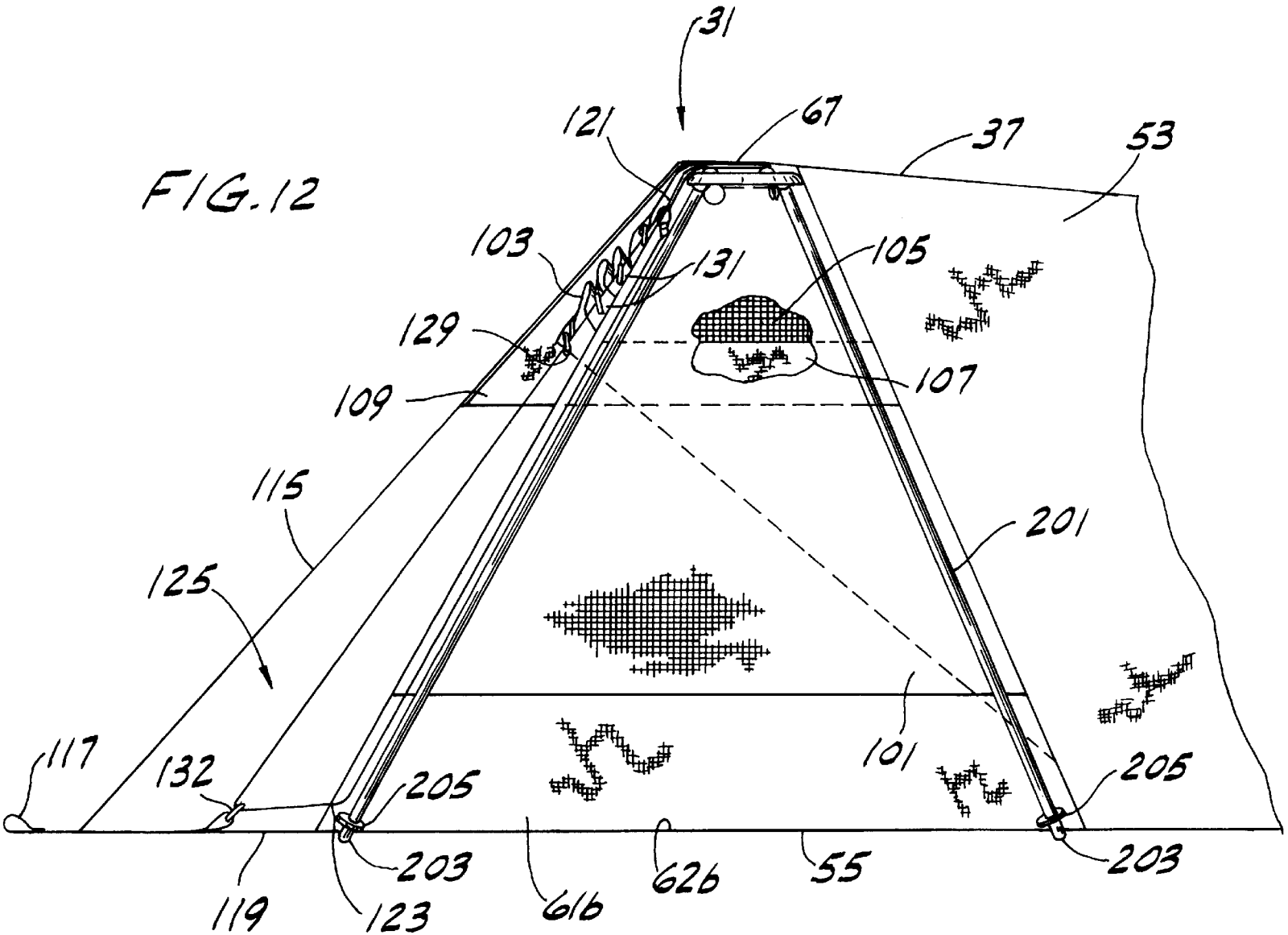
FIG. 12 is a schematic of FIG. 7 showing the window flap in a non-covering position.

Referring to FIGS. 11 and 12, with the window flap 103 in its covering position, air in the interior space of the tent 21 is ventilated through the mesh upper portion 105 of the window flap 103 and the mesh window panel 101 at the head end 31 of the tent 21 and also through the mesh window panel at the foot end 33 of the tent. When increased ventilation is desired, the user can move the window flap 103 to its non-covering position by pulling down on the portion of the cord 127 extending within the interior space of the tent 21 between the upper and lower openings 121, 123 in the end wall 55 of the shell 23. Pulling down on the cord 127 effects an upward pull on the metal ring 129 attached to the bottom edge of the window flap 103, the result being that the window flap is raised to its non-covering position to expose a greater portion of the mesh window panel 101. The clamp 135 is moved to its non-clamping position and slipped along the cord 127 to adjacent the upper opening 121 of the end wall 55. It is then released to move to its clamping position. Since the clamp 135 cannot be pulled through the upper opening 121, the window flap 103 is thus secured in its raised, non-covering position. To lower the window flap 103 to its covering position, the clamp 135 is moved to its non-clamping position, slipped down along the cord 127 to a position generally intermediate the upper and lower openings 121, 123 and then released to again clamp itself to the cord. The portion of the cord 127 extending within the interior space of the tent 21 is pulled upward, effecting a downward pull on the metal ring 129 attached to the bottom edge of the flap 103 to pull the flap down to its covering position.

Figure 13:
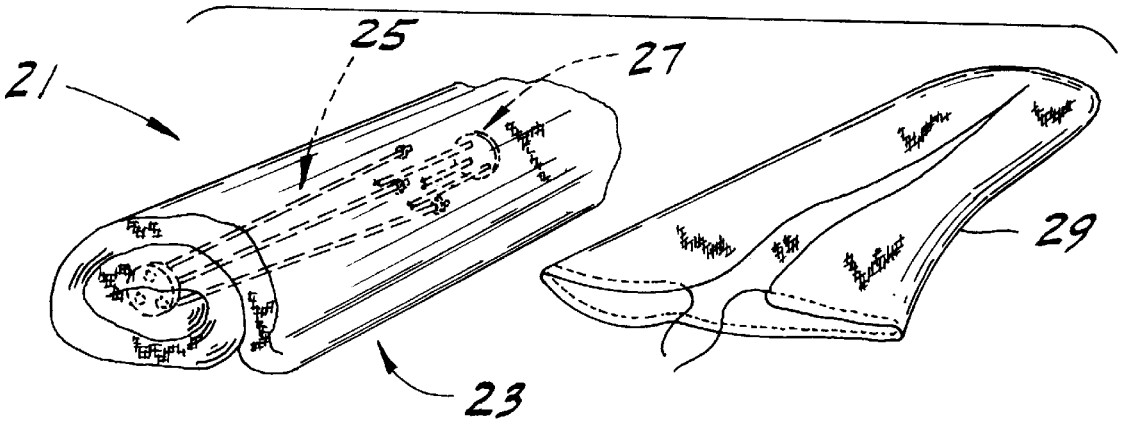
FIG. 13 is a perspective of the tent of the present invention shown compacted for storage and transport.

To collapse the tent 21 for storage and transport, the user unfastens the zipper fastener 77 to open the door 75 and then exits the tent. The tent stakes are pulled from the ground to release the tension in the guys 115 so that the side walls 51, 53, end walls, 55, 57, floor 35 and roof 59 of the shell 23 become limp. The frames 25, 27 are moved to their collapsed position by urging the frame members 201 together against the bias of the torsion springs 225. It is not necessary that the cross-support be removed from the sleeve attached to the roof 59 of the shell 23. As shown in FIG. 13, the shell 23 is then folded, rolled, or otherwise gathered around the frames 25, 27 to secure the frames in their collapsed position. The compacted tent 21 is then placed in the storage bag 29 along with the tent stakes for storing and transporting the tent 21.

In view of the above, it will be seen that the several objects of the invention are achieved and other advantageous results attained. The pair of self-erecting frames 25, 27 at the ends of the tent 21 allow the tent to be quickly and easily erected since no frame assembly is required. Similarly, the frames 25, 27 are quickly and easily collapsed and stored without the need for disassembly. Additionally, by locating the frames 25, 27 internally of the tent shell 23, the frames cannot become separated from the shell during transport. Providing a loop 125 that extends into the interior space of the tent 21 and is connected to the window flap 103 allows the user to raise and lower the flap between its covering and non-covering positions without leaving the tent 21 and without removing or otherwise adjusting the mesh window panel 101.

As various changes could be made in the above constructions without departing from the scope of the invention, it is intended that all matter contained in the above description or shown in the accompanying drawings shall be interpreted as illustrative and not in a limiting sense.

What is claimed is:

1. A tent comprising:

an elongate shell made of limp material; and a pair of self-erecting frames at opposing ends of the shell, said frames being movable between erect configurations to support the shell so that the shell defines an interior space of the tent, and collapsed configurations in which the shell can be compacted for storage and transport of the tent, each of said self-erecting frames comprising a plurality of frame members, each having an upper end and a lower end, and a connecting system for connecting the upper ends of the frame members and biasing the lower ends of the frame members apart to move the frame to its erect configuration, the frame members being movable against the bias of the connecting system to move the frame from its erect configuration to its collapsed configuration;

the self-erecting frames being connected to the shell so that movement of the frames toward their erect configurations expands the shell of the tent to facilitate erection of the tent.

2. A tent as set forth in claim 1 wherein the shell comprises a floor and a canopy connected to the floor along a peripheral edge margin of the floor, the lower ends of the frame members of each frame being connected to the floor whereby movement of the frames to their erect configurations expands the floor until the floor is taut, with further separation of the lower ends of each frame member being limited by the floor.

3. A tent as set forth in claim 2 further comprising guys at opposite ends of the tent adapted to be anchored to the ground for holding the frames in fixed position relative to one another with the shell stretching relatively tautly therebetween.

4. A tent as set forth in claim 2 wherein the lower end of each of said frame members is connected to the floor of the shell.

5. A tent as set forth in claim 1 wherein the connecting system comprises a retaining member having an opening therein corresponding to each frame member, said connecting system receiving the frame members in the openings of the retaining member and retaining the upper ends of the frame member in fixed relationship relative to one another while permitting angular movement of the frame members relative to the retaining member, and a biasing system for biasing the lower ends of the frame members apart.

6. A tent as set forth in claim 1 wherein a portion of said shell comprises a mesh window panel to permit air flow in and out of the interior space of the tent, said tent further comprising a window flap connected to the shell adjacent the window panel for covering the window panel, and means within the interior space of the tent for selectively moving the window flap between a covering position in which the flap covers the window panel and a non-covering position in which the window panel is exposed, said moving means allowing the flap to be moved between its covering and non-covering position by a person inside the interior space of the tent without removing any portion of the shell to access the window flap.

7. A tent as set forth in claim 6 wherein said shell has an upper opening located generally above the window panel and a lower opening located generally below the window panel, said window flap being connected to the shell above the window panel such that the flap hangs down over the window panel in its said covering position, said moving means comprising a loop made of flexible cord, said loop passing through the upper and lower openings of the shell such that a portion of the loop is accessible from within the interior space of the tent while the remaining portion of the loop extends exterior of the shell adjacent the window panel, a bottom edge of the window flap being connected to the loop whereby pulling down on the portion of the loop in the interior space of the tent pulls the window flap up to its non-covering position to expose the window panel and pulling up on the portion of the loop in the interior space of the tent pulls the window flap down to its covering position to cover the window panel.

8. A tent comprising:

an elongate shell constructed of a limp material and a frame supporting the shell in an erect configuration so that the shell defines an interior space of the tent, a portion of said shell comprising a mesh window panel to permit air flow in and out of the interior space of the tent, said tent further comprising a window flap connected to the shell exterior of the window panel for covering the window panel, and means accessible from within the interior space of the tent for selectively moving the window flap between a covering position in which the window flap covers the window panel and a non-covering position in which the window panel is exposed, said moving means allowing the window flap to be moved between its covering and non-covering position by a person inside said interior space of the tent without opening the shell to access the window flap.

9. A tent as set forth in claim 8 wherein said shell further comprises an upper opening located generally above the window panel and a lower opening located generally below the window panel, said window flap being connected to the shell above the window panel such that the flap hangs down over the window panel in its said covering position, said moving means comprising a loop made of flexible cord, said loop passing through the upper and lower openings of the shell such that a portion of the loop is accessible from within the interior space of the tent while the remaining portion of the loop extends exterior of the shell adjacent the window panel, a bottom edge of the window flap being connected to the loop whereby pulling down on the portion of the cord in the interior space of the tent pulls the window flap up to its non-covering position to expose the window panel and pulling up on the portion of the cord in the interior space of the tent pulls the window flap down to its covering position to cover the window panel.

10. A self-erecting frame for supporting a tent in an erect configuration of the tent, said frame comprising:

a plurality of frame members, each frame member having an upper end and an lower end;

a rigid retaining member having openings therein for receiving the upper ends of the frame members, the frame members being pivotably retained by said retaining member to permit pivoting movement of the frame members with respect to the retaining member; and torsion springs associated with the frame members for biasing the frame members apart to define an erect configuration of the frame, said frame members being pivotably movable against the bias of the torsion springs to define a collapsed configuration of the frame.

11. A tent comprising:

an elongate shell made of limp material; and a pair of self-erecting frames at opposing ends of the shell, said frames being movable between erect configurations to support the shell so that the shell defines an interior space of the tent, and collapsed configurations in which the shell can be compacted for storage and transport of the tent, each of said self-erecting frames comprising:

a plurality of frame members, each having an upper end and a lower end, and a connecting system for connecting the upper ends of the frame members and biasing the lower ends of the frame members apart to move the frame to its erect configuration, the frame members being movable against the bias of the connecting system to move the frame from its erect configuration to its collapsed configuration;

the self-erecting frames being connected to the shell so that movement of the frames toward their erect configurations expands the shell of the tent to facilitate erection of the tent;

each frame comprising at least three frame members configured so that when the frame is in its erect configuration a first of the frame members is located at a respective end of the shell and second and third frame members are located on opposite sides of the shell, the frame members being so arranged relative to the shell that when the frame is in its said erect configuration, the interior space of the tent is unobstructed by the frame from one end of the shell to the other.

12. A tent as set forth in claim 11 wherein each frame is a tripod frame having only said first, second and third frame members.

13. A tent comprising:

an elongate shell made of limp material; and a pair of self-erecting frames at opposing ends of the shell, said frames being movable between erect configurations to support the shell so that the shell defines an interior space of the tent, and collapsed configurations in which the shell can be compacted for storage and transport of the tent, each of said self-erecting frames comprising:

a plurality of frame members, each having an upper end and a lower end, and a connecting system for connecting the upper ends of the frame members and biasing the lower ends of the frame members apart to move the frame to its erect configuration, the frame members being movable against the bias of the connecting system to move the frame from its erect configuration to its collapsed configuration;

the self-erecting frames being connected to the shell so that movement of the frames toward their erect configurations expands the shell of the tent to facilitate erection of the tent;

the connecting system comprising a retaining member having an opening therein corresponding to each frame member, said connecting system receiving the frame members in the openings of the retaining member and retaining the upper ends of the frame member in fixed relationship relative to one another while permitting angular movement of the frame members relative to the retaining member, and a biasing system for biasing the lower ends of the frame members apart;

said retaining member being a generally rigid plate;

the upper ends of the frame members being generally spherical and having diameters substantially greater than that of the openings such that the upper end of each frame member is received in a respective opening in the plate to form a ball and socket joint thereby permitting pivotal movement of the frame member relative to the plate.

14. A tent as set forth in claim 13 wherein the connecting system further comprises a cap attached to the plate and covering the upper ends of the frame members to securely retain the upper ends of the frame members in the openings of the plate while permitting pivotal movement of the frame members relative to the plate.

15. A tent as set forth in claim 13 wherein said biasing system comprises a torsion spring corresponding to each of said frame members, each torsion spring having a first end connected to a respective frame member and a second end connected to the plate of said connecting system, the torsion springs being adapted for biasing the lower ends of the frame members apart.

16. A tent as set forth in claim 15 wherein the plate has a channel formed therein corresponding to each of the torsion springs, each channel having open ends for receiving the second end of a respective torsion spring, the second end of the respective torsion spring extending through the open ends of the channel, the bias of the torsion spring causing the second end of the spring to bear against the plate generally adjacent the channel such that the second end of the spring is retained within the channel of the plate.

17. A tent comprising:

an elongate shell made of limp material; and a pair of self-erecting frames at opposing ends of the shell, said frames being movable between erect configurations to support the shell so that the shell defines an interior space of the tent, and collapsed configurations in which the shell can be compacted for storage and transport of the tent, each of said self-erecting frames comprising:

a plurality of frame members, each having an upper end and a lower end, and a connecting system for connecting the upper ends of the frame members and biasing the lower ends of the frame members apart to move the frame to its erect configuration, the frame members being movable against the bias of the connecting system to move the frame from its erect configuration to its collapsed configuration;

the self-erecting frames being connected to the shell so that movement of the frames toward their erect configurations expands the shell of the tent to facilitate erection of the tent;

a portion of said shell comprising a mesh window panel to permit air flow in and out of the interior space of the tent, said tent further comprising a window flap connected to the shell adjacent the window panel for covering the window panel, and means within the interior space of the tent for selectively moving the window flap between a covering position in which the flap covers the window panel and a non-covering position in which the window panel is exposed, said moving means allowing the flap to be moved between its covering and non-covering position by a person inside the interior space of the tent without removing any portion of the shell to access the window flap;

the shell having an upper opening located generally above the window panel and a lower opening located generally below the window panel, said window flap being connected to the shell above the window panel such that the flap hangs down over the window panel in its said covering position, said moving means comprising a loop made of flexible cord, said loop passing through the upper and lower openings of the shell such that a portion of the loop is accessible from within the interior space of the tent while the remaining portion of the loop extends exterior of the shell adjacent the window panel, a bottom edge of the window flap being connected to the loop whereby pulling down on the portion of the loop in the interior space of the tent pulls the window flap up to its non-covering position to expose the window panel and pulling up on the portion of the loop in the interior space of the tent pulls the window flap down to its covering position to cover the window panel;

the tent further comprising guys at opposite ends of the shell adapted to be anchored to the ground for holding the frames in fixed position relative to one another with the shell stretching relatively taut therebetween, and coupling means for coupling the loop with one of said guys such that the portion of the loop exterior of the shell extending between the coupling means and the upper opening of the shell is generally taut for supporting the window flap spaced above the window panel when the window flap is in its covering position.

* * * * *